US005848916A

United States Patent [19]

Huang

[11] Patent Number: 5,848,916

[45] Date of Patent: Dec. 15, 1998

[54] CHRISTMAS LAMP SOCKET

[76] Inventor: Shun-Feng Huang, No. 13, Lane 84, Nei Hu Road, Hsin-Chu City, Taiwan

[21] Appl. No.: 850,684

[22] Filed: May 2, 1997

[51] Int. Cl.[6] ..... H01R 17/00

[52] U.S. Cl. ..... 439/619; 439/457

[58] Field of Search ..... 439/611, 619, 439/699.2, 356, 456, 457

[56] References Cited

U.S. PATENT DOCUMENTS 1,060,822 5/1913 Crosher ..... 439/457

5,672,077 9/1997 Wang et al. ..... 439/619

5,676,568 10/1997 Weber ..... 439/457 X

*Primary Examiner*—Khiem Nguyen

*Attorney, Agent, or Firm*—Rosenberg, Klein & Bilker

[57] ABSTRACT

A Christmas lamp socket includes a housing, a lamp base with a lamp fitted therein and inserted in the housing completely. The housing has two aligned grooves in a bottom end for a power wire to be fitted and positioned therein with a proper tenseness so as to enable the sockets kept upright to the wire and thus to prevent rain from flowing in the housing and the lamp base and from consequent short circuit.

2 Claims, 5 Drawing Sheets

CHRISTMAS LAMP SOCKET

BACKGROUND OF THE INVENTION

This invention concerns a Christmas lamp socket, particularly having a two aligned grooves and two holes in a bottom portion for fitting electric power wires so as to save time and cost in assembling.

A known conventional Christmas lamp socket shown in FIGS. 4 and 5 includes a housing 11, a lamp 12, a lamp base 13 and a power wire 14. The housing 11 has two opposite vertical tubular hooks 111, 111 for holding power wires 14, 14 in place.

However, the conventional Christmas lamp socket has drawbacks as listed below.

1. The vertical tubular hooks are definite in length, and it is not easy to insert the power wire therein. Besides, the tubular hooks may break if force used in inserting the power wire is too large, in addition to the time needed in assembling being long to result in high cost.

2. To form a mold for the housing with the tubular hooks is rather difficult, resulting in a high cost.

3. If a net of Christmas lamps using the conventional sockets is hung outdoors, rain may flow in the housing and the lamp base to cause short circuit, which has latent danger for a possible fire.

SUMMARY OF THE INVENTION

A main purpose of the invention is to offer a Christmas lamp socket having a housing provided with two aligned grooves in a bottom portion for positioning a power wire, simplifying assembling a power wire with the housing.

Another purpose of the invention is to offer a Christmas lamp socket provided with two vertical holes in the bottom portion, just for power wires to fit therein, so a lamp base may be completely inserted in a sealed condition so that rain may be prevented from flowing in the housing and the lamp base, without possibility of happening short circuit by rain.

The main feature of the invention is positioning grooves provided in a bottom end of the housing for fitting a power wire therein with a proper tenseness and two vertical holes also in the bottom end of the housing for just inserting respectively a power wire.

BRIEF DESCRIPTION OF DRAWINGS

This invention will be better understood by referring to the accompanying drawings, wherein.

DESCRIPTION OF THE PREFERRED EMBODIMENTS

Figure 1:
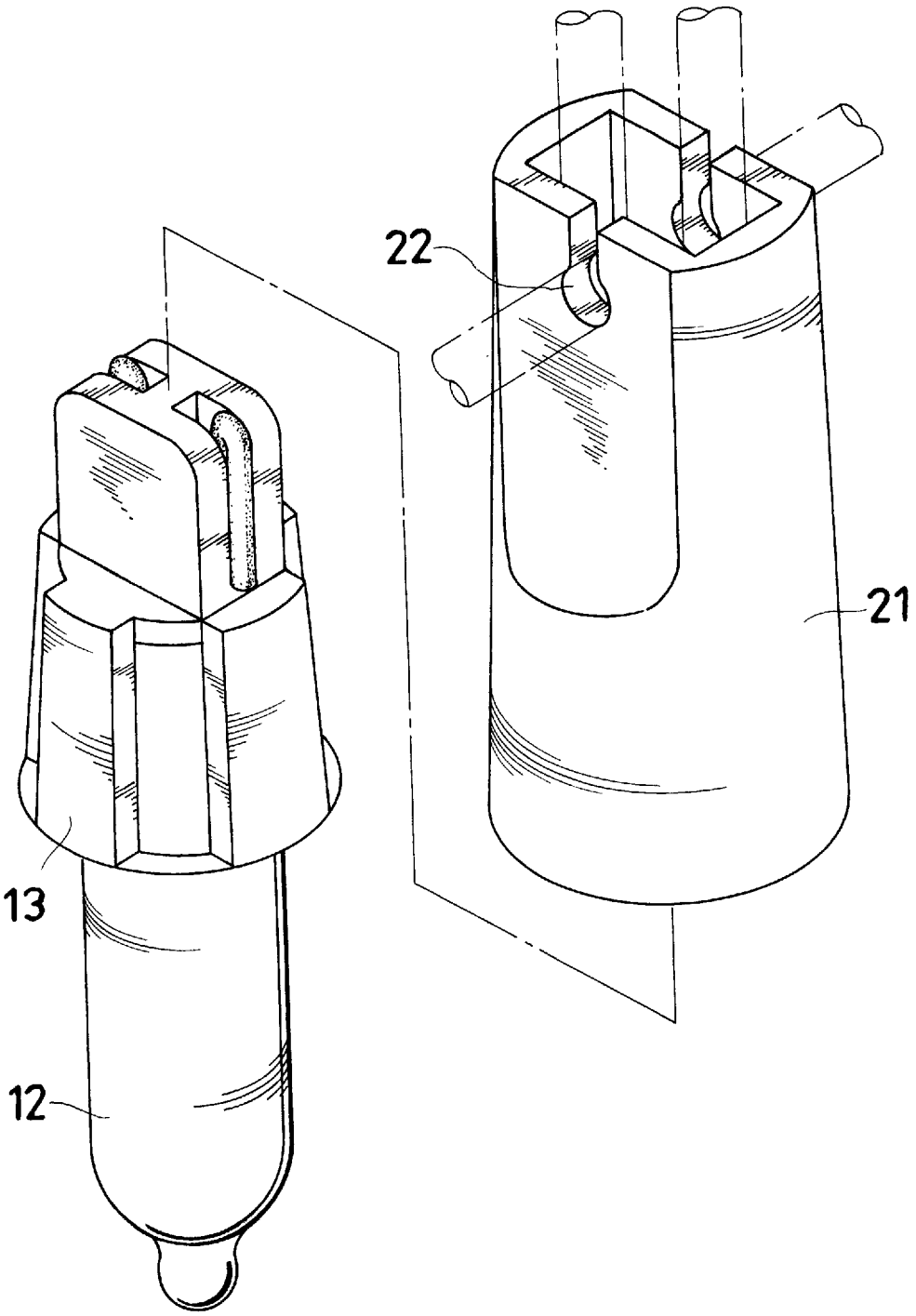
FIG. 1 is an exploded perspective view of a first embodiment of a Christmas lamp socket in the present invention.
Figure 2:
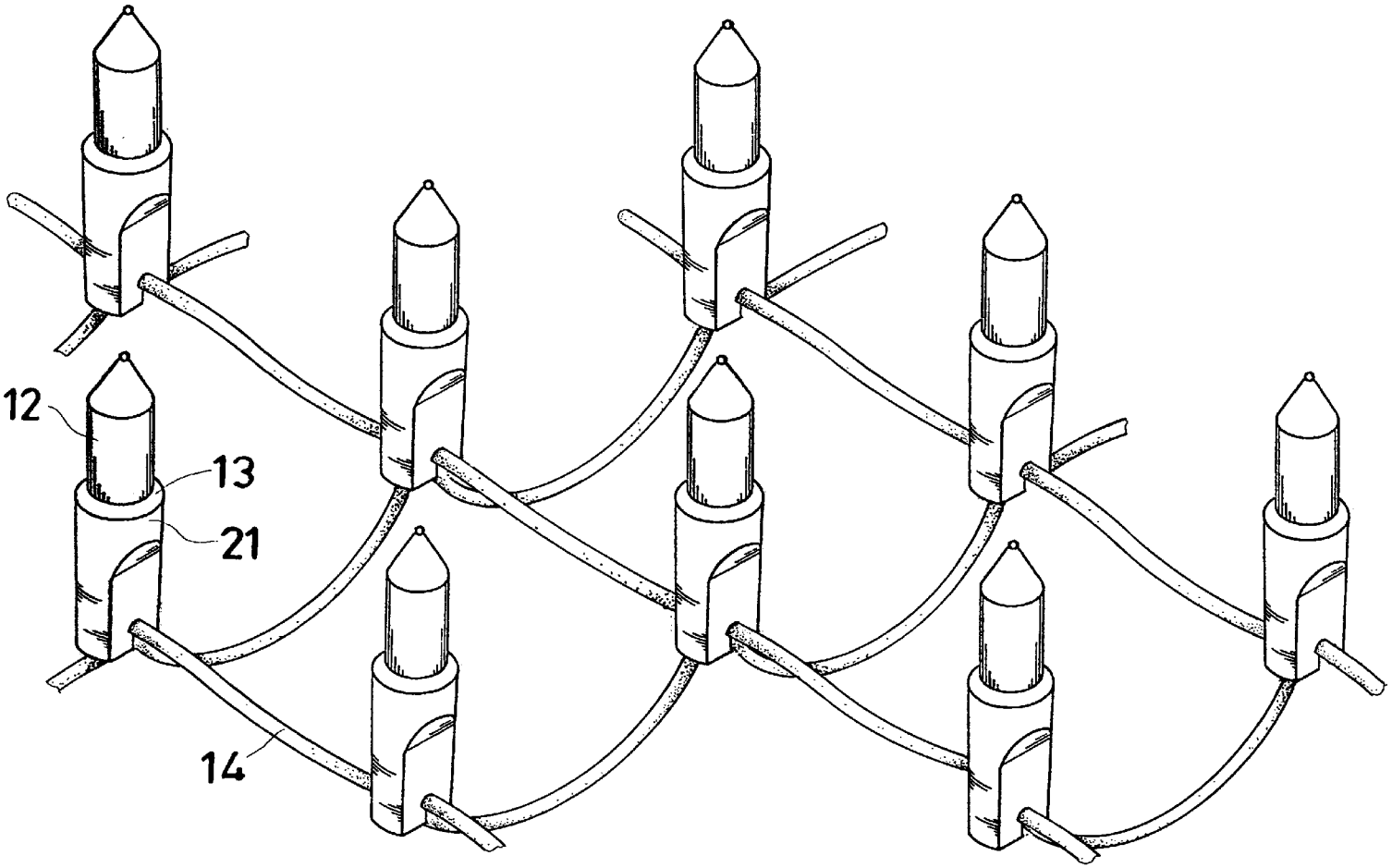
FIG. 2 is a perspective view of a net of Christmas lamps using the sockets in the present invention.

A first embodiment of a Christmas lamp socket in the present invention, as shown in FIGS. 1 and 2, includes a housing 21, a conventional lamp 12, a lamp base 13 and a power wire 14.

The housing 21 has a center hole opening to an upper side (a lower side in FIG. 1) and two aligned grooves 22, 22 in two opposite walls in a bottom end for a power wire to be fitted therein with a proper tenseness for forming a net of Christmas lamps with the sockets.

The lamp 12 is fitted in the lamp base 13, and the lamp base 13 together with the lamp 12 is inserted completely in the center hole of the housing 21.

Figure 3:
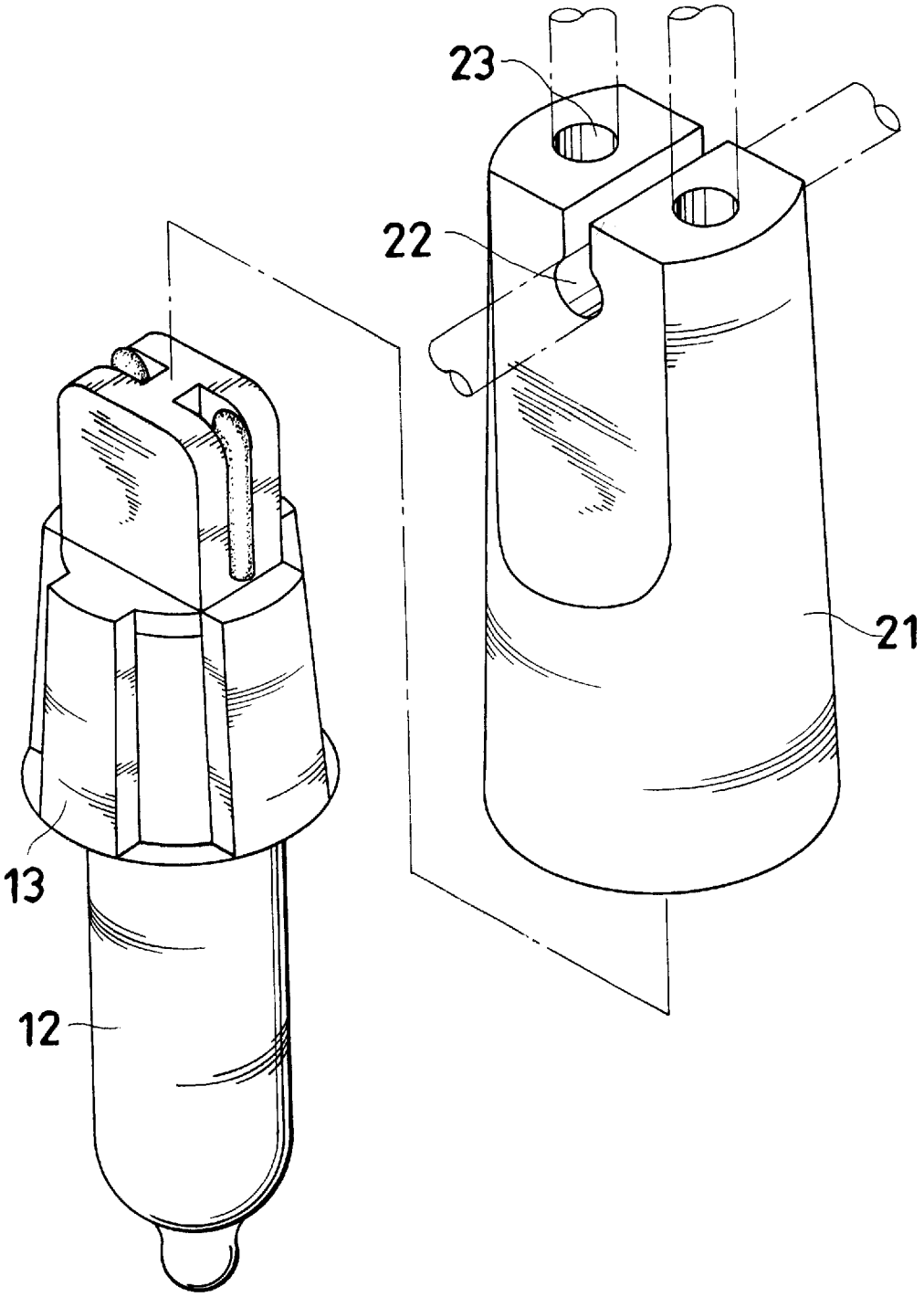
FIG. 3 is an exploded perspective view of a second embodiment of a Christmas lamp socket in the present invention.
Figure 4:
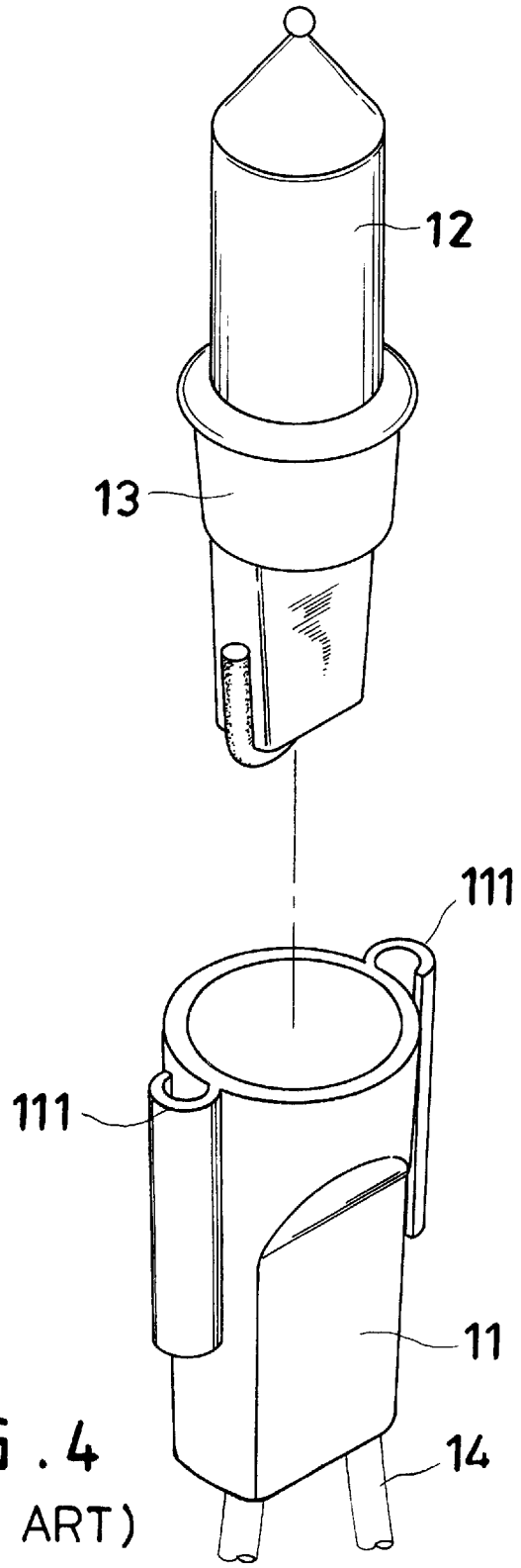
FIG. 4 (PRIOR ART)
FIG. 4 is an exploded perspective view of a known conventional Christmas lamp socket; and, FIG. 5 is a perspective view of a net of a Christmas lamps using the conventional Christmas sockets.
Figure 5:
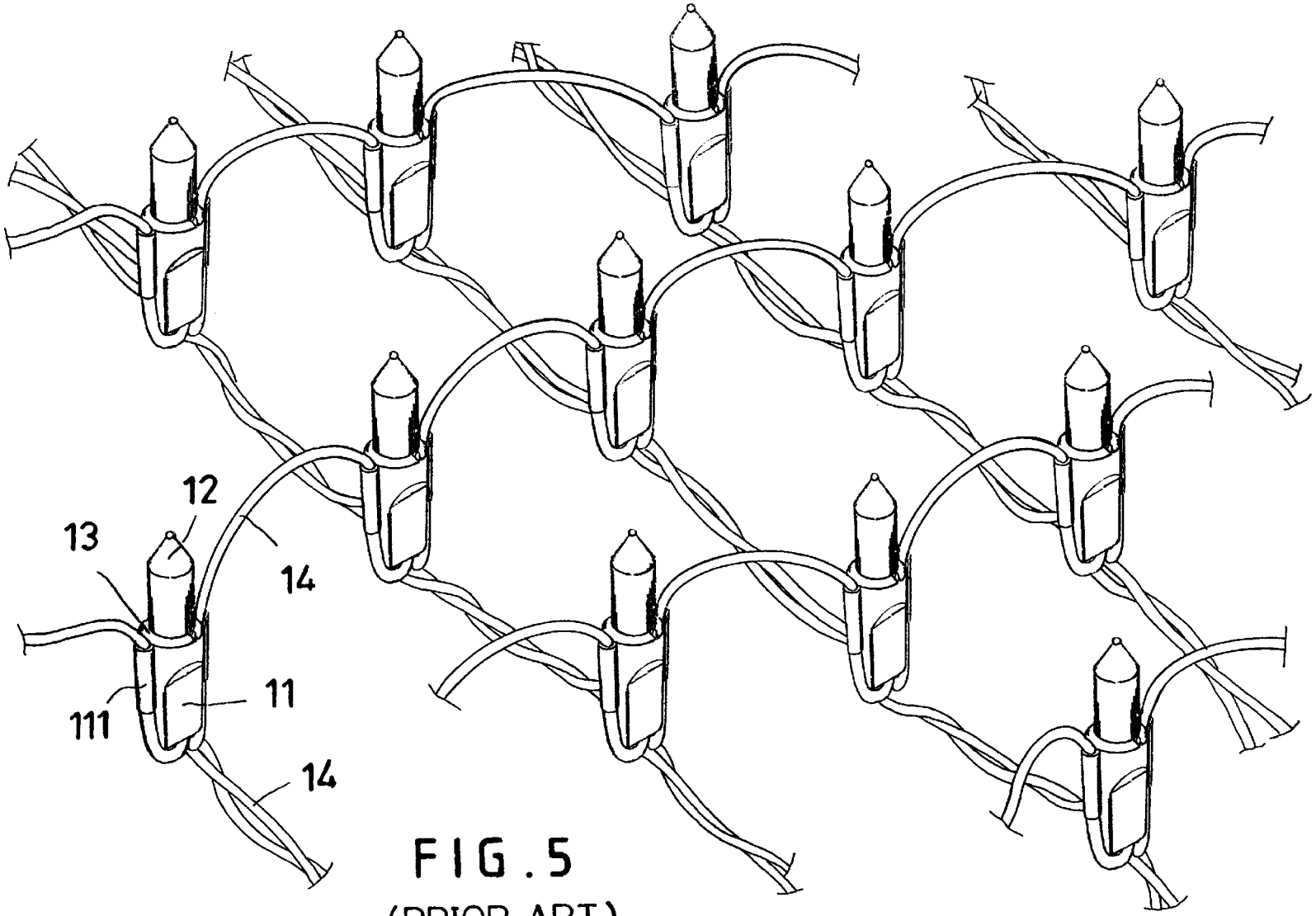
FIG. 5 (PRIOR ART)

FIG. 3 shows a second embodiment of a Christmas lamp socket in the present invention, which also includes a housing 21, a conventional lamp 12, a lamp base 13 and a power wire 14.

The housing 21 of the second embodiment has a center hole opening to an upper side (a lower side in FIG. 3) for the lamp base 13 together with the lamp 12 to insert completely therein, a straight groove 22 for fitting a power wire 14 therein with a proper tenseness, and two vertical holes 23, 23 in the two opposite sides of the straight groove 22. The two holes 23, 23 have a diameter a little larger than the diameter of the power wire 14 for the power wire 14 to pass through. Then the lamp base 13 may be said to be sealed in the housing 21 after the lamp base 13 is inserted in the housing 21, preventing rain from flowing in the housing to cause short circuit.

Compared with the conventional Christmas lamp socket, that of the present invention has the following advantages.

1. A power wire is easily fitted in the aligned grooves of the housing, saving time for assembling and cost as well.

2. The aligned grooves need a comparatively simpler structured mold for reducing the cost for it.

3. The aligned grooves of the housing enable a power wire to be pulled in an upright direction to the lamp sockets, so the lamp sockets are kept in the upright position to the surface of a roof or a wall, presenting 3D appearance, and in addition, also preventing short circuit from happening in rainy days.

4. As the two aligned grooves in the bottom end of the housing only serves a power wire to fit and pass through, the lamp base can be said to be sealed in the housing after inserted in the housing, preventing rain from flowing in the housing to the lamp base to cause short circuit if a net of Christmas lamps using the sockets of the present invention is hung outdoors.

While the preferred embodiments of the invention have been described above, it will be recognized and understood that various modifications may be made therein and the appended claims are intended to cover all such modifications which may fall within the spirit and scope of the invention.

What is claimed is:

1. A Christmas light socket assembly, comprising:

a plurality of substantially identical light sockets, each of said plurality of light sockets including:

(a) a lamp, said lamp including a pair of lead wires, said lead wires having contact portions thereof;

(b) a lamp base having an upper end and an opposing connector end thereof, said lamp base supporting said lamp within an opening formed in said upper end thereof and enveloping said pair of lead wires, said contact portions of said lead wires being externally exposed at said connector end of said lamp base;

(c) a longitudinally extended housing, said housing having a distal end and a proximal end, said housing having a central bore extending longitudinally from an opening formed in said proximal end, said connector end of said lamp base being received within said central bore, said housing having a pair of opposing side walls being at said distal end thereof, and a groove being formed in each of said opposing side walls in open communication with said distal end, said grooves being disposed in aligned relationship to thereby identify a single passage;

(d) a pair of first power wires extending within said housing of a first of said plurality of light sockets, each said first power wire having an end, electrically coupled to said contact portion of a respective one of said lead wires, said pair of first wires extending outwardly from said distal end of said housing of said first light socket; and (e) a pair of second power wires extending within said housing of a second of said plurality of light sockets and electrically coupled to said contact portion of a respective one of said lead wires of said second light socket, one of said pair of second power wires being inserted into said grooves formed in said side walls of said first light socket to extend through said single passage substantially orthogonal to said first power wires thereof, thereby interconnecting said first and said second light sockets.

2. The Christmas light socket assembly of claim 1, wherein said housing of each light socket further includes a sealing bottom having a pair of holes formed therethrough, said pair of first power wires protruding through a respective one of said holes and said single passage extending through said sealing bottom.

* * * * *